United States Patent [19]

Ikeda

[11] Patent Number: 4,989,761

[45] Date of Patent: Feb. 5, 1991

[54] DETERGENT DISPENSER FOR A WASHING MACHINE OR THE LIKE

[75] Inventor: Yoshio Ikeda, Aichi, Japan

[73] Assignee: Kabushiki Kaisha Toshiba, Kawasaki, Japan

[21] Appl. No.: 284,702

[22] Filed: Dec. 15, 1988

[30] Foreign Application Priority Data

Dec. 19, 1987 [JP] Japan ..... 62-321756

[51] Int. Cl.[5] ..... G01F 11/00

[52] U.S. Cl. ..... 222/231; 222/233; 222/236; 222/240

[58] Field of Search ..... 222/63, 129.4, 144.5, 222/200, 232, 233, 234, 243, 245, 226, 231, 413; 366/309, 311; 425/209

[56] References Cited

U.S. PATENT DOCUMENTS

| | | | |
|---|---|---|---|
| 647,769 | 4/1900 | Strawbridge | 222/245 |
| 2,123,318 | 8/1937 | Taylor | 222/233 |
| 2,181,078 | 5/1937 | Dehuff | 366/309 |
| 2,794,577 | 6/1957 | Van Leeuwan | 222/232 |
| 3,359,748 | 12/1967 | Booth | 222/144.5 |
| 4,207,995 | 6/1980 | Neely | 222/236 |

FOREIGN PATENT DOCUMENTS

| | | |
|---|---|---|
| 42-18769 | 9/1967 | Japan . |
| 54-43827 | 12/1979 | Japan . |
| 58-85282 | 6/1983 | Japan . |

*Primary Examiner*—Michael S. Huppert

*Attorney, Agent, or Firm*—Foley & Lardner, Schwartz, Jeffery, Schwaab, Mack, Blumenthal & Evans

[57] ABSTRACT

A detergent dispenser for a washing machine includes a detergent container for containing a certain amount of powdered detergent, a detergent discharger for discharging a necessary amount of powdered detergent from the container to a detergent receiver of the washing machine, a shaft rotated upon operation of the detergent discharger, a crank mechanism for changing the rotational movement of the shaft to the reciprocal movement, a reciprocating member reciprocally moved by the crank mechanism in the detergent container in the direction of one of end walls of the detergent container and in the direction opposite to the end wall so that the powdered detergent adherent to the inside surface of each end wall of the detergent container is removed.

6 Claims, 5 Drawing Sheets

DETERGENT DISPENSER FOR A WASHING MACHINE OR THE LIKE

BACKGROUND OF THE INVENTION

1. Field of the Invention

This invention relates to a detergent dispenser for dispensing detergent such as powdered detergent to a wash tub of a washing machine or the like, and more particularly to such a detergent dispenser wherein a necessary amount of powdered detergent is dispensed to the wash tub from a detergent container containing a predetermined amount of powdered detergent.

2. Description of the Prior Art

Prior art detergent dispensers of the above-described type are disclosed in Japanese Published Patent Application (Kokoku) Nos. 42-18769 and 54-43827. Such a prior art detergent dispenser comprises a detergent container containing a predetermined amount of detergent. An amount of detergent necessary for the washing is fed into a wash tub of the washing machine or a portion thereof communicating to the wash tub by a screw or valve provided at the lower end of the detergent container.

The detergent contained in the detergent container is likely to adhere to the inside surface of peripheral walls of the detergent container, particularly to the inside surface of oppositely disposed end walls thereof. Consequently, the detergent adherent to the inside surface of the end walls remains unfed to the wash tub, which entails a problem of efficient use of the detergent.

SUMMARY OF THE INVENTION

Therefore, an object of the present invention is to provide a detergent dispenser for a washing machine or the like wherein the detergent may be prevented from adhering to the inside surface of the ends walls of the detergent container, thereby providing with efficient use of the detergent.

According to one aspect of this invention, the detergent dispenser for a washing machine or the like comprises a detergent container for containing detergent, the detergent container having peripheral walls at least including oppositely disposed end walls, a discharging means for discharging the detergent contained in the detergent container to a detergent receiving portion of the washing machine, a shaft rotated upon operation of the discharging means, a crank mechanism for changing the rotational movement of the shaft to the reciprocal movement, and a reciprocating member to which the reciprocal movement is transmitted from the crank mechanism, the reciprocating member being moved in the detergent container in the direction of one of the end walls of the detergent container and in the direction opposite to the end wall, whereby a force is reiteratively applied by the reciprocating member to the detergent adherent to the inside surface of the end walls of the detergent container so that the detergent adherent to the inside surface of the end walls of the detergent container is removed.

According to another aspect of the invention, the detergent dispenser for a washing machine or the like comprises a detergent container for containing detergent, the detergent container having peripheral walls at least including oppositely disposed end walls, a discharging means for discharging the detergent contained in the detergent container to a detergent receiving portion of the washing machine, an agitating member rotated upon operation of the discharging means, and a reciprocating member being moved, upon rotation of the agitating member, in the detergent container in the direction of one of the end walls of the detergent container and in the direction opposite to the end wall, whereby a force is reiteratively applied by the reciprocating member to the detergent adherent to the inside surface of the end walls of the detergent container so that the detergent adherent to the inside surface of the end walls of the detergent container is removed.

According to the detergent dispenser of the present invention, the detergent adherent to the inside surface of the end walls of the detergent container may be removed and consequently, the detergent does not remain unfed in the detergent container, thereby providing with efficient use of the detergent.

Other and further objects of the present invention will become obvious upon an understanding of the illustrative embodiment about to be described or will be indicated in the appended claims, and various advantages not referred to herein will occur to one skilled in the art upon employment of the invention in practice.

DESCRIPTION OF THE PREFERRED EMBODIMENT

Figure 2:
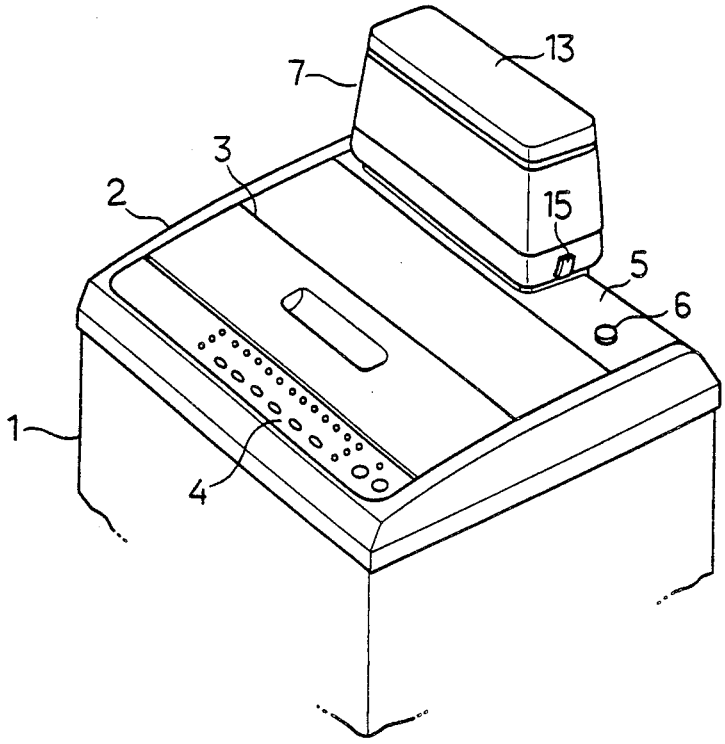
FIG. 2 is a perspective view of the detergent dispenser mounted on a washing machine.

One embodiment of the detergent dispenser for washing machines or the like in accordance with the present invention will now be described with reference to the accompanying drawings Referring first to FIG. 2, the detergent dispenser is mounted on a washing machine of the top-loading type. The washing machine includes an outer cabinet 1 and an upper cover 2 secured to the upper end of the outer cabinet 1. An opening (not shown) is formed in the upper cover 2 and an access lid 3 of the folding type is hingedly mounted for opening and closing the opening so that clothes are loaded and unloaded through the opening. An operation panel 4 is provided in the front edge of the upper cover 2. A rear panel 5 is mounted in a rear area of the upper cover 2 and an electrical power switch 6 and a hopper 7 are provided on the rear panel 5. The hopper 7 serves as a detergent container for containing a certain amount of powdered detergent.

Figure 1:
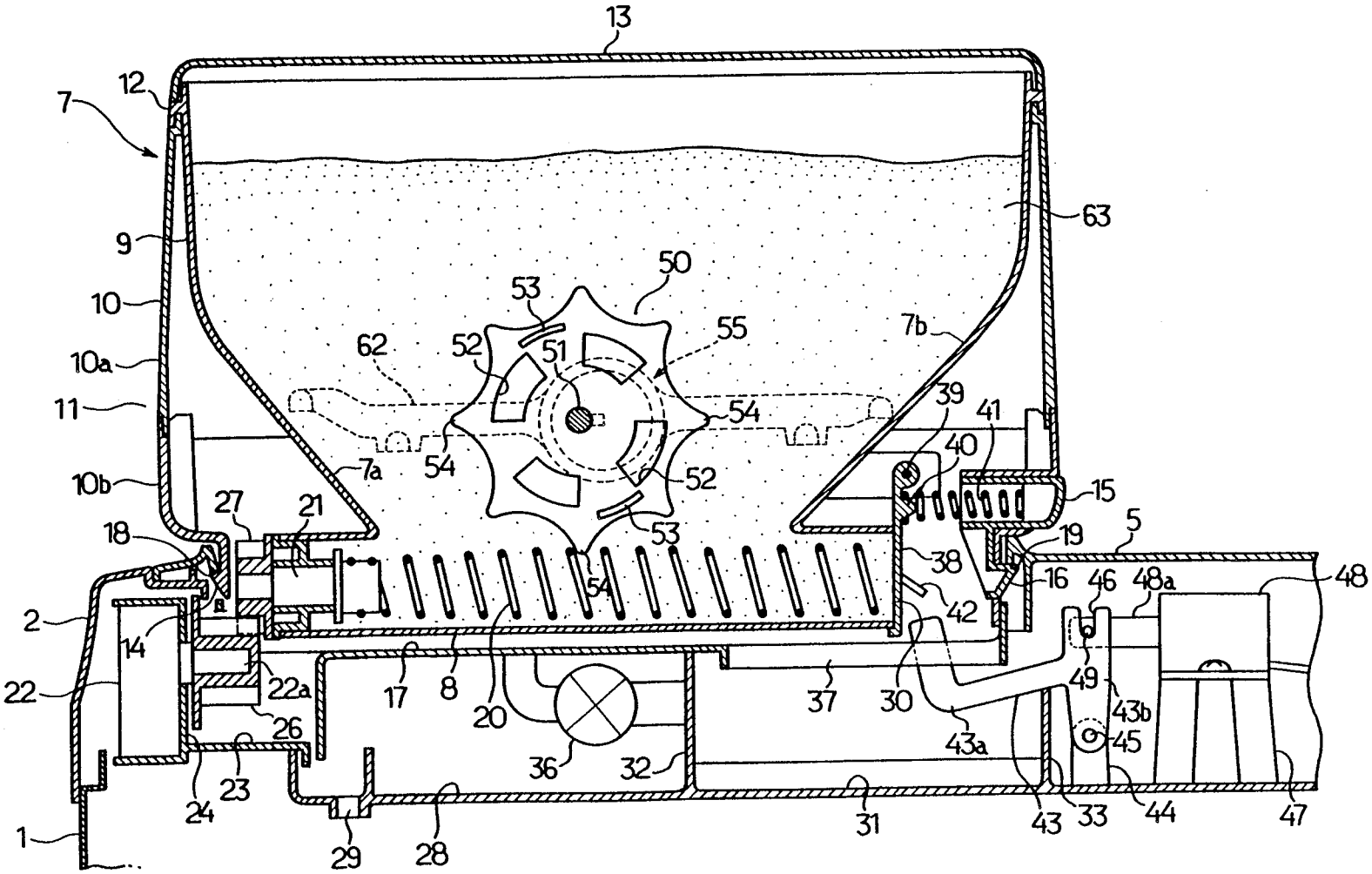
FIG. 1 is a longitudinal sectional view of the major part of the detergent dispenser in accordance with the invention.
Figure 3:
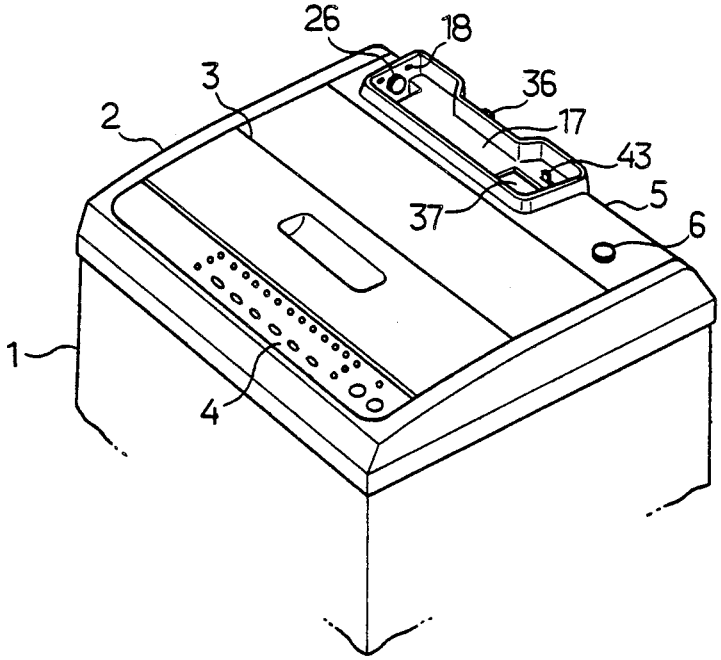
FIG. 3 is a partially perspective view of the washing machine with the detergent dispenser detached.

The hopper 7 will now be described in detail with reference to FIG. 1. The peripheral wall 11 of the hopper 7 includes inner walls 9 and outer walls 10 encompassing the inner walls 9. A cylindrical detergent discharging passageway 8 is laterally formed adjacent to the lowest portion of the hopper 7. The outer wall 10 comprises upper and lower walls 10*a* and 10*b* formed independently with each other and coupled with each other. The top of the outer wall 10 is inserted in the inside of a rib 12 formed along the upper periphery of the inner wall 9 so that the outer wall 10 is coupled to the inner wall 9. The hopper 7 has an upper open end through which detergent is supplied to the hopper 7. A hopper lid 13 is provided for closing the upper open end of the hopper 7. A claw 14 is formed integrally with the lower portion 10*b* of the outer wall 10 at the lower left-hand side of the outer wall 10, as viewed in FIG. 1. Another claw 16 is formed integrally with a push button 15 at the lower right-hand side of the outer wall 10, as viewed in FIG. 1. The push button 15 will be described in detail later. A recess 17 is formed in the rear panel 5 as shown in FIG. 3 as well as FIG. 1. An opening 18 is formed at the left-hand side of the recess 17 and another opening 19 is formed at the right-hand side of the recess 17, as viewed in FIG. 1. The claws 14 and 16 are inserted in the openings 18 and 19 and engaged therewith, respectively, whereby the hopper 7 is detachably mounted on the rear panel 5.

Figure 4:
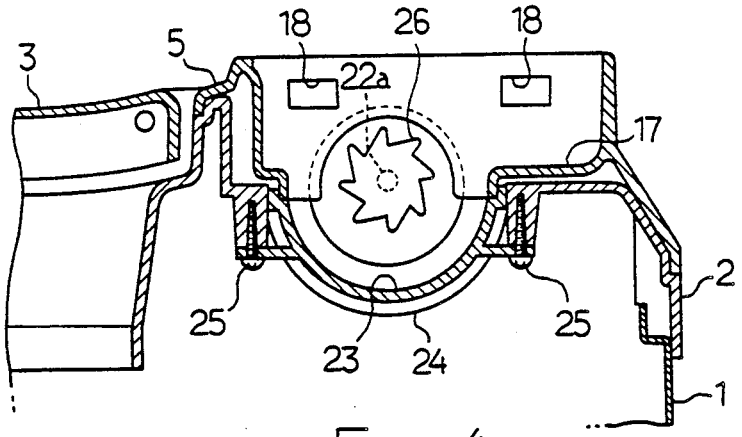
FIG. 4 is a longitudinal sectional view of the lower portion of the detergent dispenser.

A detergent discharging means 20 is beforehand provided in the detergent discharging passageway 8 which is positioned in the recess 17 when the hopper 7 is mounted on the rear panel 5. The detergent discharging means 20 comprises a helical coil in this embodiment. The left-hand end of the helical coil is secured to a transmission shaft 21 inserted in one end of the detergent discharging passageway 8 for rotative movement, as viewed in FIG. 1. An electric motor 22 is provided so as to be covered with the upper cover 2 at the left-hand side, as viewed in FIG. 1. The motor 22 is covered with a water-proof cover 24 having a water receiving portion 23 which is secured to the upper cover 2 by a screw 25, as shown in FIG. 4. A driving gear 26 which also serves as a water-proof cap is secured on a rotational shaft 22*a* of the motor 22. A driven gear 27 is secured on an end of the transmission shaft 21, which end is projected from the detergent discharging passageway 8. The driven gear 27 is in mesh engagement with the driving gear 26.

Figure 5:
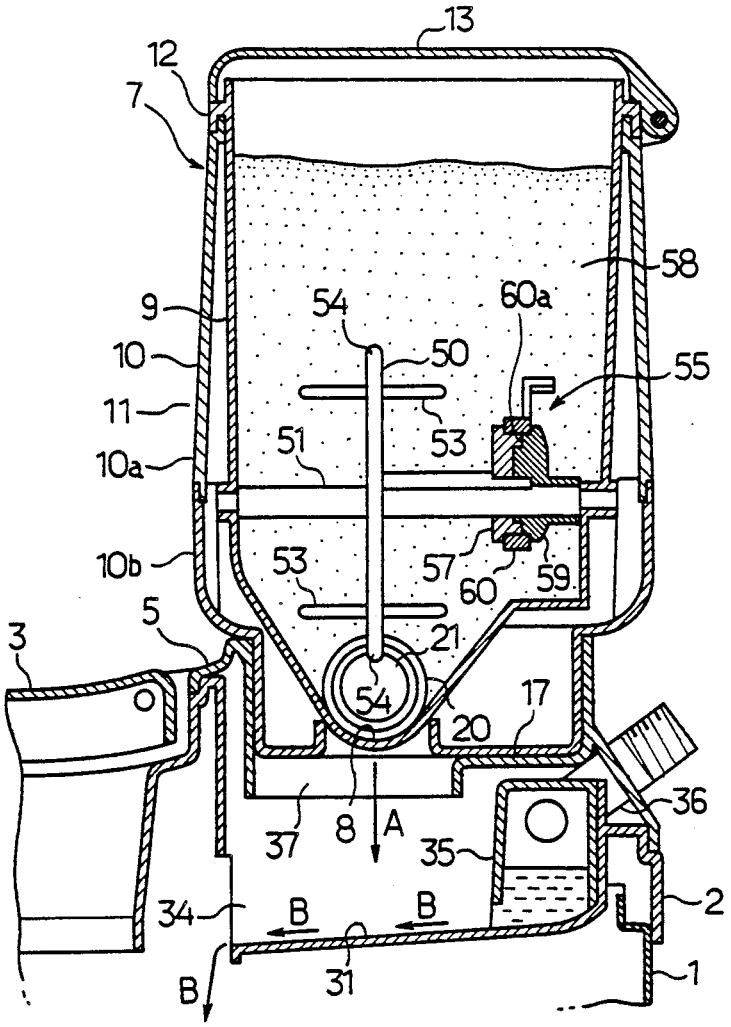
FIG. 5 is a longitudinal sectional view of the detergent dispenser.

A recess 28 is formed nearly over the area of the upper cover 2. The recess 28 has a water outlet 29 in the vicinity of the water receiving portion 23. The water outlet 29 faces a wash tub (not shown) provided within the outer cabinet 1. A detergent receiving portion 31 is defined by partition walls 32 and 33 in the recess 28 so as to be positioned below a detergent discharging outlet 30 of the detergent discharging passageway 8. As shown in FIG. 5, the bottom of the detergent receiving portion 31 is inclined, and a detergent supply outlet 34 is formed at the lowest end of the detergent receiving portion 31 so as to face the interior of the wash tub. The detergent receiving portion 31 has a water reservoir 35 at the end opposite to the detergent supply outlet 34. The water reservoir 35 communicates to the detergent receiving portion 31. The water reservoir 35 is provided with a water supply valve 36. An opening 37 is formed in the bottom of the recess 17 so as to be positioned over the detergent receiving portion 31. The detergent discharged by the detergent discharging means 20 falls to the detergent receiving portion 31 through the opening 37. The opening 37 is also utilized for cleaning the detergent receiving portion 31.

A small lid 38 is provided so as to close the detergent discharging outlet 30. As shown in FIG. 1, the lid 38 is pivotally mounted at the upper end on a shaft 39 provided on the lower portion 10*b* of the outer wall 10 of the hopper 7. The lid 38 has, at the upper end, a projection 40 which is positioned opposite to the push button 15. A coil spring 41 is provided between the push button 15 and the projection 40 of the lid 38, whereby the push button 16 is urged outwardly and the lid 38 is urged inwardly or in the direction of the detergent discharging outlet 30. Accordingly, the lid 38 usually closes the detergent discharging outlet 30 owing to the urging force induced by the spring 41. The lid 38 has an inclined tongue strip 42 formed in the vicinity of the outer side lower end of the lid 38. A working rod 43 includes an elongated L-shaped portion 43*a* and a base portion 43*b*. The working rod 43 is rotatably mounted, at the lower end of the base portion 43*b*, on a support shaft 45 provided on a support projection 44 formed outside the detergent receiving portion 31. The base portion 43*b* of the working rod 43 has a bifurcate portion 46 at the upper end. An electromagnet 48 is secured to a support 47 placed at the right-hand side of the working rod 43. The bifurcate portion 46 of the working rod 43 is coupled by a pin 49 with one end of a plunger 48*a* of the electromagnet 48.

An agitating member 50 is mounted on a shaft 51 rotatably supported by oppositely disposed inner and outer side walls 9 and 10 in the hopper 7. The agitating member 50 has a plurality of openings circumferentially formed and a plurality of projections 53 extending from both sides thereof. The agitating member 50 also has a number of circumferential projections 54. Each one of the circumferential projections 54 is engaged with the detergent discharging means 20 in turn.

Figure 6:
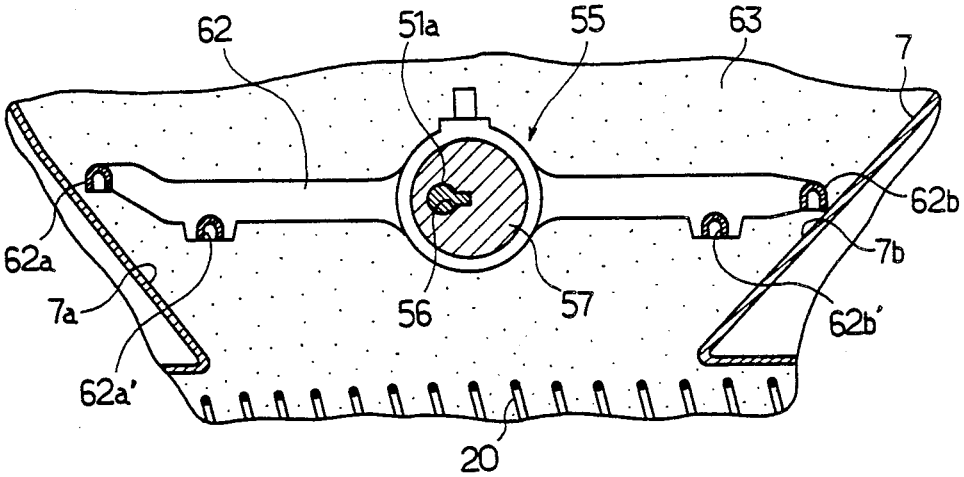
FIG. 6 is a longitudinal sectional view illustrating the shaft, crank mechanism, and reciprocating member of the detergent dispenser.
Figure 7:
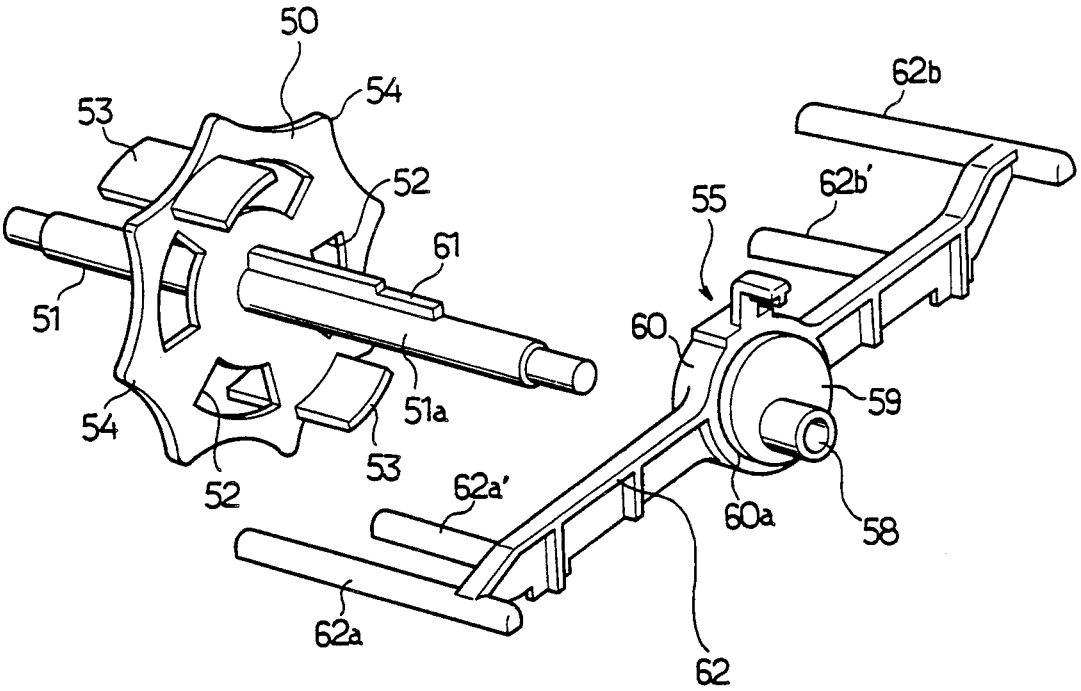
FIG. 7 is an exploded perspective view of the shaft, crank mechanism, and reciprocating member of the detergent dispenser.

Referring now to FIGS. 5, 6 and 7, a crank mechanism 55 comprises first short columnar crank members 57 and 59 having keyhole-like openings 56 and 58 eccentrically formed relative to the agitating member 50 respectively and a second short columnar crank member 60. The first crank members 57 and 59 are fitted together and provide with a circumferential groove 60*a* in which the second crank member 60 is rotatably inserted. A portion 51*a* of the shaft 51 having a keyhole-shaped section and a projection 61 on the periphery thereof is inserted in the opening 56 of the first crank member 57. The shaft 51 is further inserted in the opening 58 of the other first crank member 59, whereby the first crank members 57 and 59 are rotated with the shaft 51. A reciprocating member 62 extends from the second crank member 60 along the side walls in the directions of both end walls 7*a* and 7*b* of the hopper 7. The reciprocating member 62 has diverged, for example, bifurcated ends 62*a*, 62*a*' and 62*b*, 62*b*' positioned in the vicinity of the both inclined end walls 7*a* and 7*b* of the inner walls 9 respectively. When the second crank member 60 is rotated around the groove 60*a*, the reciprocating member 62 are moved along the end walls 7*a* and 7*b* of the inner walls 9, respectively. The bifurcated ends 62*a*, 62*a*' and 62*b*, 62*b*' of the reciprocating members 62 are extended in the directions intersecting perpendicularly with respect to the directions in which the reciprocating member 62 is moved, respectively. Each of the bifurcated ends 62*a*, 62*a*', 62*b* and 62*b*' has an inverted U-shaped section.

Figure 8:
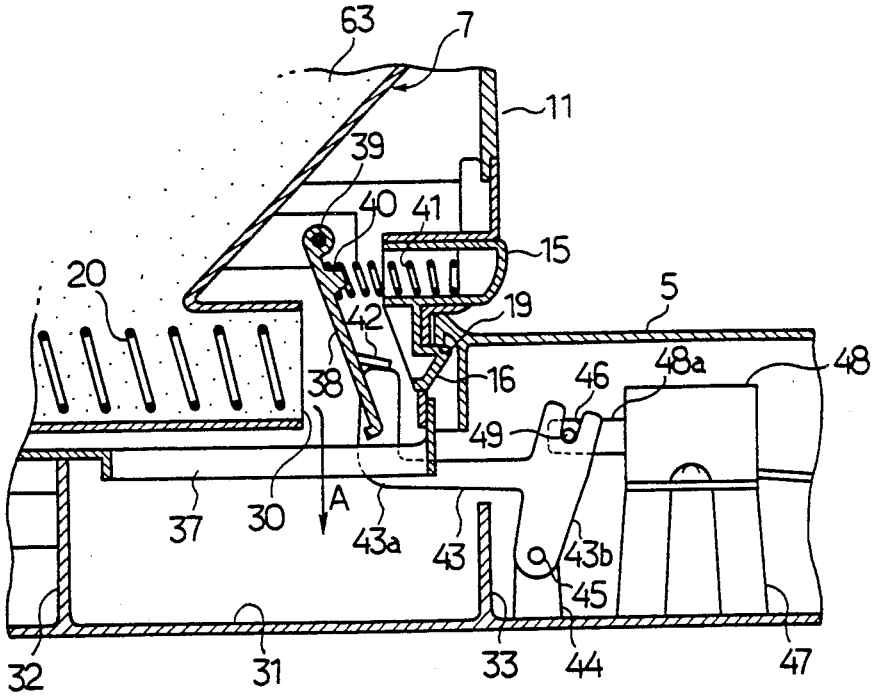
FIG. 8 is a view similar to FIG. 1 in the condition that the detergent is being discharged by the detergent dispenser.

Operation of the detergent dispenser will now be described. When the push button 15 is depressed against the force of the spring 41, the claw 16 is disengaged from the opening 19. The claw 14 is then disengaged from the opening 18 and the hopper 7 is lifted, thereby detaching the hopper 7 from the washing machine. The hopper lid 13 is opened and the hopper 7 is filled with a certain amount of powdered detergent 63, thereby re-closing the hopper lid 13. The hopper 7 is then attached to the washing machine. When switches (not shown) on the operation panel 4 are operated to execute the washing operation, control means (not shown) comprising a microcomputer and incorporated in the operation panel 4 is operated so that the electromagnet 48, motor 22 and water supply valve 36 are first energized. The electromagnet 48 causes the plunger 48*a* to be withdrawn and accordingly, the plunger 48*a* causes the bifurcated end 46 of the working rod 43 to be withdrawn. Consequently, the working rod 43 is rotatably moved as shown in FIG. 8. The distal end of the L-shaped portion 43*a* is brought into contact with the inclined tongue strip 42 of the small lid 38, thereby pushing the lid 38 upwardly. The lid 38 is opened against the force of the spring 41. Whereas, when the motor 22 is energized to be started, the rotation of the rotational shaft 22*a* is transmitted to the driving gear 26, driven gear 27, transmission shaft 21 and detergent discharging means 20 in turn. Upon rotation of the detergent discharging means 20, the powdered detergent 63 contained in the hopper 7 is fed forward toward the outlet 30 in the detergent discharging passageway 8. From the outlet 30, the powdered detergent 63 falls into the detergent receiving portion 31 as shown by arrow A in FIG. 8. Since the water supply valve 36 is energized to be opened, water flows through the water reservoir 35 into the detergent receiving portion 31 as shown by arrow B in FIG. 5. The powdered detergent 63 in the detergent receiving portion 31 is caused to be flown with the water to the detergent supply outlet 34, from which the powdered detergent 63 is supplied into the washing tub of the washing machine with the water.

Figure 9:
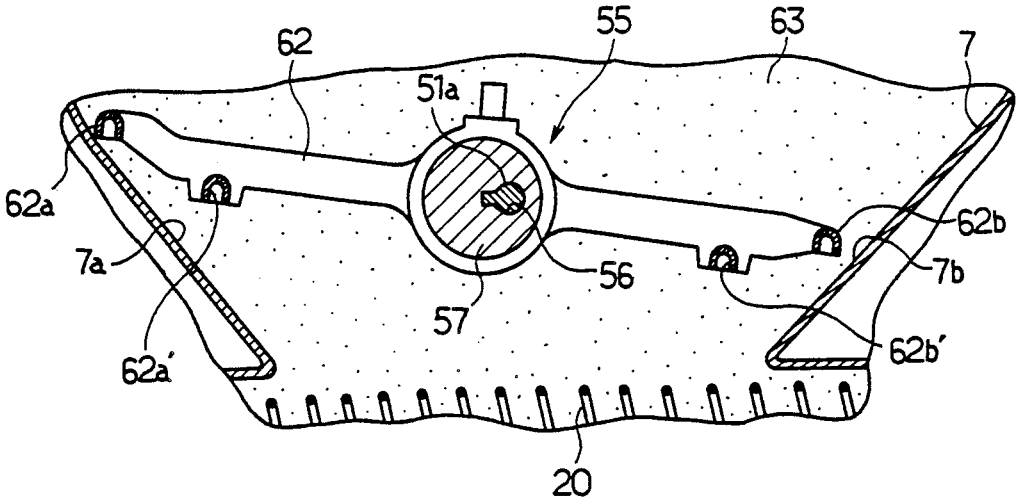
FIG. 9 is a view similar to FIG. 6 illustrating a condition different from that in FIG. 6.

When the detergent discharging means 20 is driven as described above, the agitating member 50 having one of the projections 54 engaged with the detergent discharging means 20 is rotated so that the projections 54 are engaged with the detergent discharging means 20 one after another, whereby the powdered detergent 63 is agitated to enhance the introducing of the detergent into the discharging passageway 8. With rotation of the agitating member 50, rotation of the shaft 51 of the agitating member 50 is transmitted to the first crank members 57 and 59 of the crank mechanism 55. Rotation of the first crank members 57, 59 causes the second crank member 60 to turn around the groove 60*a*, whereby the reciprocating member 62 are reciprocally moved in the directions of the end wall 7*a* and opposite thereto and in the directions of the end wall 7*b* and opposite thereto. As viewed in FIG. 9, the movement of the reciprocating member 62 to the left causes the end 62*a* thereof to come into contact, at the outer lower edge thereof having the inverted U-shaped section, with the left-hand end wall 7*a*, whereby the ends 62*a* and 62*a*' are raised along the end wall 7*a*, while the other ends 62*b* and 62*b*' are lowered along the right-hand end wall 7*b*. Whereas, the movement of the reciprocating member 62 to the right causes the end 62*b* thereof to come into contact, at the outer lower edge thereof having the inverted U-shaped section, with the right-hand end wall 7*b*, whereby the ends 62*b* and 62*b*' are raised along the end wall 7*b*, while the other ends 62*a* and 62*a*' are lowered along the end wall 7*b*.

When the reciprocating member 62 are reciprocally moved in the directions of the end walls 7*a*, 7*b* and opposite to end walls 7*a*, 7*b*, forces are reiteratively applied to the powdered detergent so that the powdered detergent 63 adherent to the walls 7*a*, 7*b* are removed therefrom. Particularly, since the reciprocating member 62 are moved along the end walls 7*a*, 7*b* which are inclined, the forces which remove the powdered detergent 63 from the end walls 7*a*, 7*b* are effective.

Since the reciprocating member 62 is provided so as to extend from the second crank member 60 in opposite directions, the powdered detergent adherent to both of the end walls 7*a*, 7*b* may be removed, thereby enhancing the effectiveness of the forces removing the detergent from the end walls 7*a*, 7*b*. Furthermore, since the bifurcated ends 62*a*, 62*a*' and 62*b*, 62*b*' are moved in contact with the end walls 7*a*, 7*b* respectively, the powdered detergent which has already stuck to the walls 7*a*, 7*b* may be wiped away. Furthermore, the bifurcated ends 62*a*, 62*a*', 62*b* and 62*b*' of the reciprocating members 62 allows to cover the walls 7*a*, 7*b* widely respectively. Moreover, each of the ends 62*a* and 62*b* of the reciprocating member 62 has an inverted U-shaped section and the outer lower edge of each end is adapted to come into contact with the respective end walls 7*a*, 7*b*, enhancing the removal of the detergent stuck to the walls. Additionally, since the reciprocating member 62 are moved upon the movement of the agitating member 50, thereby simplifying the construction of the detergent dispenser.

Each of the electromagnet 48, motor 22 and water supply valve 36 is deenergized after a necessary amount of powdered detergent 63 is supplied to the wash tub of the washing machine. When the electromagnet 48 is deenergized, the small lid 38 is released and returned to the closing position by the force of the spring 41. Upon deenergization of the motor 22, the detergent discharging means 20 stops rotating, thereby stopping the feeding of the detergent. Upon deenergization of the water supply valve, water supply to the detergent receiving portion 31 is stopped.

Although the detergent receiving portion 31 is formed in the rear panel of the washing machine in the foregoing embodiment, the detergent receiving portion may be a wash tub. More specifically, the detergent may be directly supplied from the hopper 7 to the wash tub without using water. Further, although the detergent discharging means comprises a coil spring in the foregoing embodiment, it may be a conventional valve or screw. A drive source of the detergent discharging means is not limited to the motor 22. A water driven wheel provided in a water supply passage may be a drive source of the detergent discharging means. Although the detergent dispenser of the invention is applied to the clothes washing machine in the foregoing embodiment, it may be applied to other equipments in which any kind of detergent is used, for example, a dish washer.

The foregoing disclosure and drawings are merely illustrative of the principles of the present invention and are not to be interpreted in a limiting sense. The only limitation is to be determined from the scope of the appended claims.

I claim:

1. A detergent dispenser for a washing machine or the like, comprising:

(a) a detergent container for containing detergent, the detergent container having peripheral walls at least including oppositely disposed inclined end walls;

(b) detergent discharging means for discharging the detergent contained in the detergent container to a detergent receiving portion of the washing machine or the like;

(c) a shaft provided so as to be rotated upon operation of the detergent discharging means;

(d) a crank mechanism for changing the rotational movement transmitted from the shaft to the reciprocal movement; and (e) a reciprocating member having opposite end portions positioned so as to correspond to the inclined end walls of the detergent container, respectively, the end portions being reciprocally moved in the detergent container in the directions of the end walls and in the directions opposite to the end walls by transmission of the reciprocal movement to the reciprocating member from the crank mechanism, the end portions of the reciprocating member being moved along the inclined inside surfaces of the end walls of the detergent container when moved in the directions of the end walls, respectively, and the end portions of the reciprocating member being alternately brought into sliding contact with the end walls of the detergent container for the majority of their stroke as the reciprocating member is reciprocally moved.

2. A detergent dispenser as claimed in claim 1, wherein the shaft is eccentrically mounted on the crank mechanism and wherein the crank mechanism comprises a pair of first crank members and a second crank member rotatably mounted on the first crank members and wherein the reciprocating member is extended from the second crank member in the directions of both end walls of the detergent container so that the end portions of the reciprocating member is alternately brought into sliding contact with the end walls of the detergent container.

3. A detergent dispenser as claimed in claim 1, wherein both end portions of the reciprocating member are diverged and have extended portions extended in the directions intersecting perpendicularly to the directions in which the end portions of the reciprocating member is moved along the end walls of the detergent container, respectively.

4. A detergent dispenser as claimed in claim 1, wherein each extended end of the reciprocating member has a generally inverted U-shaped section and wherein the outer lower edges of the extended ends of the reciprocating member are brought into contact with the inside surfaces of both end walls of the detergent container, respectively.

5. A detergent dispenser for a washing machine or the like, comprising:

(a) a detergent container for containing detergent, the detergent container having peripheral walls at least including oppositely disposed inclined end walls;

(b) detergent discharging means for discharging the detergent contained in the detergent container to a detergent receiving portion of the washing machine or the like;

(c) an agitator agitating the detergent contained in the detergent container, the agitator being rotated upon operation of the detergent discharging means; and (d) a reciprocating member reciprocally moved in the detergent container in the direction of one of the end walls of the detergent container and in the direction opposite to the end wall, upon rotation of the agitator, the reciprocating member having opposite end portions positioned so as to correspond to the end walls of the detergent container, the end portions of the reciprocating member being moved along the inclined surfaces of the end walls of the detergent container when moved in the directions of the end walls, respectively, and the end portions of the reciprocating member being alternately brought into sliding contact with the end walls of the detergent container for the majority of their strokes as the reciprocating member is reciprocally moved.

6. A detergent dispenser as claimed in claim 5, wherein the reciprocating member is operatively coupled to the agitator.

* * * * *